US008344908B2

(12) United States Patent
Johnson

(10) Patent No.: US 8,344,908 B2
(45) Date of Patent: Jan. 1, 2013

(54) MONITORING MANAGEMENT AND PRESENTATION OF PREEMPTION CONTROL DATA OF CENTRALLY MANAGED TRAFFIC SIGNALS

(75) Inventor: David Randal Johnson, Oakdale, MN (US)

(73) Assignee: Global Traffic Technologies, LLC, St. Paul, MN (US)

( * ) Notice: Subject to any disclaimer, the term of this patent is extended or adjusted under 35 U.S.C. 154(b) by 550 days.

(21) Appl. No.: 12/576,641

(22) Filed: Oct. 9, 2009

(65) Prior Publication Data

US 2011/0084854 A1 Apr. 14, 2011

(51) Int. Cl.
*G08G 1/07* (2006.01)

(52) U.S. Cl. ..... 340/906; 701/301

(58) Field of Classification Search ..... 340/909, 340/910, 916, 917, 919, 924, 906; 701/300, 701/301

See application file for complete search history.

(56) References Cited

U.S. PATENT DOCUMENTS

| | | | |
|---|---|---|---|
| 5,187,476 | A | 2/1993 | Hamer |
| 5,202,683 | A | 4/1993 | Hamer et al. |
| 5,539,398 | A | 7/1996 | Hall et al. |
| 5,602,739 | A | 2/1997 | Haagenstad et al. |
| 6,064,319 | A | 5/2000 | Matta |
| 6,621,420 | B1 | 9/2003 | Poursartip |
| 6,985,090 | B2 | 1/2006 | Ebner et al. |
| 7,307,547 | B2 | 12/2007 | Schwartz |
| 7,333,028 | B2 | 2/2008 | Schwartz |
| 7,417,560 | B2 | 8/2008 | Schwartz |
| 7,515,064 | B2 | 4/2009 | Schwartz |
| 2005/0264431 | A1 | 12/2005 | Bachelder |

FOREIGN PATENT DOCUMENTS

| | | |
|---|---|---|
| DE | 198 42 912 | 3/2000 |
| WO | 2005/094544 | 10/2005 |

*Primary Examiner* — Thomas Mullen
(74) *Attorney, Agent, or Firm* — Crawford Maunu PLLC

(57) ABSTRACT

Managing traffic signal preemption data accumulated at a plurality of intersections. In one approach a method includes reading the preemption data stored at each of the intersections. The preemption data includes for each preemption request an emitter code, and a date and a time the preemption request was submitted. The preemption data read from the intersections are stored in a database, and each emitter code is associated with a vehicle name in the database. Selected preemption data and associated vehicle names are read from the database in response to user input, and the selected preemption data and associated vehicle names are displayed. The database further stores data identifying the intersection from which the preemption data was read.

18 Claims, 17 Drawing Sheets

System Usage Report

From 9/27/2009 to 9/28/2009

Jurisdictions included : Capital City, Shelbyville, Springfield, Metro Transit

Report Generated :
9/28/2009 12:00 PM

| | Summary of Intersections/Vehicles | Attempted Preempts | Granted Preempts | Average Granted Preempts |
|---|---|---|---|---|
| | High Priority | | | |
| 256 | Intersections | 11 | 11 | 0.0 |
| 27 | Registered Vehicles | 6 | 6 | 0.2 |
| 1 | Unregistered Vehicles | 5 | 5 | 5.0 |
| 3 | Authorized Vehicles | 11 | 11 | 3.7 |
| 0 | Unauthorized Vehicles | 0 | 0 | 0.0 |
| | Low Priority | | | |
| 256 | Intersections | 0 | 0 | 0.0 |
| 12 | Registered Vehicles | 0 | 0 | 0.0 |
| 0 | Unregistered Vehicles | 0 | 0 | 0.0 |
| 0 | Authorized Vehicles | 0 | 0 | 0.0 |
| 0 | Unauthorized Vehicles | 0 | 0 | 0.0 |

System Usage Report: Page 1/1

*FIG. 10*

Top Preempting Vehicles Report

From 9/21/2009 to 9/28/2009

Jurisdictions included : Shelbyville, Metro Transit

Report Generated :
9/28/2009 12:00 PM

| Agency Jurisdiction | Agency Name | Vehicle Name | Vehicle ID | Emitter Code | Priority | Preempt Count |
|---|---|---|---|---|---|---|
| Shelbyville | Shelbyville Fire | Shelbyville Ladder 1 | E001100135VKGX W3MVWY9P0EWT | 5000 | High | 45 |
| Shelbyville | Shelbyville Fire | Shelbyville Tanker 1 | E0011001350S78LH 9AOMKDGIHF | 5002 | High | 30 |
| Shelbyville | Shelbyville Fire | Shelbyville Engine 1 | E001100135JZ9ZIK5 MN02BTDNE | 5001 | High | 28 |
| | | Unregistered | | 1 | High | 8 |
| Capital City | Capital City Police | Capital City Cruiser 4 | E000400071UB0TJA MY310C8R2T | 1103 | High | 1 |
| Capital City | Capital City Police | Capital City Cruiser 8 | E000400071NGMDB YJDEAX7SENV | 1107 | High | 1 |

Top Preempting Vehicles Report: Page 1/1

FIG. 11

Top Preempted Intersections Report

From 8/28/2009 to 9/28/2009

Jurisdictions included : Capital City, Shelbyville, Springfield, Metro Transit

Report Generated :
9/28/2009 12:32 PM

| Jurisdiction | Intersection | Approach | Preempt Count | Priority |
|---|---|---|---|---|
| Capital City | Dalton Ave & Timber Ln | TOTAL | 15 | |
| | | South Bound | 14 | High |
| | | West Bound | 1 | High |
| Capital City | Emerald Ave & Mississippi River Blvd | TOTAL | 12 | |
| | | East Bound | 12 | High |
| Shelbyville | Lincoln Ave & Jackson St | TOTAL | 18 | |
| | | West Bound | 18 | High |
| Shelbyville | Lincoln Ave & Timber Ln | TOTAL | 14 | |
| | | West Bound | 14 | High |
| Springfield | Madison Ave & State St | TOTAL | 17 | |
| | | South Bound | 17 | High |

Top Preempted Intersections Report: Page 1/1

*FIG. 12*

Unregistered Vehicle Preempt Report

From 9/27/2009 to 9/28/2009

Report Generated :
9/28/2009 11:55 AM

Jurisdictions included : Capital City, Shelbyville, Springfield, Metro Transit

| Emitter Code | Priority | Jurisdiction | Intersection | Approach | Call Start Time | Caused Preempt |
|---|---|---|---|---|---|---|
| 5003 | High | Capital City | Hillcrest Ave & Eagle Dr | East Bound | 9/28/2009 11:44:46 AM | Yes |
| 5003 | High | Capital City | Hillcrest Ave & Forest St | East Bound | 9/28/2009 11:48:28 AM | Yes |
| 5003 | High | Capital City | Hillcrest Ave & Jackson St | East Bound | 9/28/2009 11:49:26 AM | Yes |
| 5003 | High | Capital City | Hillcrest Ave & River Ridge Rd | North Bound | 9/28/2009 11:39:51 AM | Yes |
| 5003 | High | Capital City | Hillcrest Ave & Timber Ln | East Bound | 9/28/2009 11:49:01 AM | Yes |

Unregistered Vehicle Preempt Report: Page 1/1

FIG. 13

Long Call Duration Report

From 9/26/2009 to 9/28/2009

Jurisdictions included : Capital City, Shelbyville, Springfield, Metro Transit

Report Generated :
9/28/2009 11:43 AM

| Agency Jurisdiction | Agency | Vehicle | Emitter Code | Priority | Intersection Jurisdiction | Intersection | Approach | Call Start Time | Duration (seconds) |
|---|---|---|---|---|---|---|---|---|---|
| | | Unregistered | 5003 | High | Capital City | Hillcrest Ave & River Ridge Rd | North Bound | 9/28/2009 11:39:51 AM | 293 |
| Springfield | Springfield Police | Springfield Cruiser 1 | 3100 | High | Springfield | Madison Ave & State St | South Bound | 9/28/2009 11:33:57 AM | 256 |
| Springfield | Springfield Police | Springfield Cruiser 1 | 3100 | High | Springfield | Madison Ave & Main St | East Bound | 9/28/2009 11:38:57 AM | 196 |

Long Call Duration Report: Page 1/1

FIG. 14

Inactive Vehicles Report

From 8/28/2009 to 9/28/2009

Jurisdictions included : Capital City, Shelbyville, Springfield, Metro Transit

Report Generated :
9/28/2009 11:35 AM

| Agency Jurisdiction | Agency Name | Vehicle Name | Vehicle ID | Emitter Code | Priority |
|---|---|---|---|---|---|
| Capital City | Capital City Fire | Capital City Ladder 1 | E000400021LTSRW YZCBFUK5Q2K | 1000 | High |
| Capital City | Capital City Fire | Capital City Foam 2 | S000200121SEF8FX XTBA04SMPZ | 1009 | High |
| Capital City | Capital City Police | Capital City Cruiser 1 | E000400071Q4J1N9 6R0DWUWFUD | 1100 | High |
| Capital City | Capital City Police | Capital City Cruiser 3 | E000400071CRWDJ HMAM6Z2R5FU | 1102 | High |
| Capital City | Capital City Police | Capital City Cruiser 7 | E000400071RZFJ3L ZXUZARINR9 | 1106 | High |

Inactive Vehicles Report: Page 1/1

FIG. 15

Inactive Intersections Report

From 9/28/2008 to 9/28/2009
Jurisdictions included : Capital City

Report Generated :
9/28/2009 11:38 AM

| Jurisdiction | Intersection | Approach | Priority |
|---|---|---|---|
| Capital City | American Ave & Birch Ln | North Bound | Low |
| Capital City | American Ave & Birch Ln | South Bound | High |
| Capital City | American Ave & Birch Ln | South Bound | Low |
| Capital City | American Ave & Birch Ln | East Bound | High |
| Capital City | American Ave & Birch Ln | East Bound | Low |
| Capital City | American Ave & Birch Ln | West Bound | High |
| Capital City | American Ave & Birch Ln | West Bound | Low |
| Capital City | American Ave & Commerce St | North Bound | Low |
| Capital City | American Ave & Commerce St | South Bound | High |
| Capital City | American Ave & Commerce St | South Bound | Low |
| Capital City | American Ave & Commerce St | East Bound | Low |
| Capital City | American Ave & Commerce St | West Bound | Low |
| Capital City | American Ave & Duff St | North Bound | Low |
| Capital City | American Ave & Duff St | South Bound | Low |
| Capital City | American Ave & Duff St | East Bound | High |

*FIG. 16*

MONITORING MANAGEMENT AND PRESENTATION OF PREEMPTION CONTROL DATA OF CENTRALLY MANAGED TRAFFIC SIGNALS

FIELD OF THE INVENTION

The present invention is generally directed to traffic control preemption systems.

BACKGROUND

Traffic signals have long been used to regulate the flow of traffic at intersections. Generally, traffic signals have relied on timers or vehicle sensors to determine when to change traffic signal lights, thereby signaling alternating directions of traffic to stop, and others to proceed.

Emergency vehicles, such as police cars, fire trucks and ambulances, generally have the right to cross an intersection against a traffic signal. Emergency vehicles have in the past typically depended on horns, sirens and flashing lights to alert other drivers approaching the intersection that an emergency vehicle intends to cross the intersection. However, due to hearing impairment, air conditioning, audio systems and other distractions, often the driver of a vehicle approaching an intersection will not be aware of a warning being emitted by an approaching emergency vehicle.

Traffic control preemption systems assist authorized vehicles (police, fire and other public safety or transit vehicles) through signalized intersections by making a preemption request to the intersection controller. The controller will respond to the request from the vehicle by changing the intersection lights to green in the direction of the approaching vehicle. This system improves the response time of public safety personnel, while reducing dangerous situations at intersections when an emergency vehicle is trying to cross on a red light. In addition, speed and schedule efficiency can be improved for transit vehicles.

There are presently a number of known traffic control preemption systems that have equipment installed at certain traffic signals and on authorized vehicles. One such system in use today is the OPTICOM® system. This system utilizes a high power strobe tube (emitter), located in or on the vehicle, that generates light pulses at a predetermined rate, typically 10 Hz or 14 Hz. A receiver, which includes a photo detector and associated electronics, is typically mounted on the mast arm located at the intersection and produces a series of voltage pulses, the number of which are proportional to the intensity of light pulses received from the emitter. The emitter generates sufficient radiant power to be detected from over 2500 feet away. The conventional strobe tube emitter generates broad spectrum light. However, an optical filter is used on the detector to restrict its sensitivity to light only in the near infrared (IR) spectrum. This minimizes interference from other sources of light.

Intensity levels are associated with each intersection approach to determine when a detected vehicle is within range of the intersection. Vehicles with valid security codes and a sufficient intensity level are reviewed with other detected vehicles to determine the highest priority vehicle. Vehicles of equivalent priority are selected in a first come, first served manner. A preemption request is issued to the controller for the approach direction with the highest priority vehicle travelling on it.

Another common system in use today is the OPTICOM® GPS priority control system. This system utilizes a GPS receiver in the vehicle to determine location, speed, and heading of the vehicle. The information is combined with security coding information that consists of an agency identifier, vehicle class, and vehicle ID and is broadcast via a proprietary 2.4 GHz radio.

An equivalent 2.4 GHz radio located at the intersection along with associated electronics receives the broadcasted vehicle information. Approaches to the intersection are mapped using either collected GPS readings from a vehicle traversing the approaches or using location information taken from a map database. The vehicle location and direction are used to determine on which of the mapped approaches the vehicle is approaching toward the intersection and the relative proximity to it. The speed and location of the vehicle is used to determine the estimated time of arrival (ETA) at the intersection and the travel distance from the intersection. ETA and travel distances are associated with each intersection approach to determine when a detected vehicle is within range of the intersection and, therefore, a preemption candidate. Preemption candidates with valid security codes are reviewed with other detected vehicles to determine the highest priority vehicle. Vehicles of equivalent priority are generally selected in a first come, first served manner. A preemption request is issued to the controller for the approach direction with the highest priority vehicle travelling on it.

With metropolitan-wide networks becoming more prevalent, additional means for detecting vehicles via wired networks such as Ethernet or fiber optics and wireless networks such as Mesh or 802.11b/g may be available. With network connectivity to the intersection, vehicle tracking information may be delivered over a network medium. In this instance, the vehicle location is either broadcast by the vehicle itself over the network or it may be broadcast by an intermediary gateway on the network that bridges between, for example, a wireless medium used by the vehicle and a wired network on which the intersection electronics resides. In this case, the vehicle or an intermediary reports, via the network, the vehicle's security information, location, speed and heading along with the current time on the vehicle. Intersections on the network receive the vehicle information and evaluate the position using approach maps as described in the OPTICOM® GPS system. The security coding could be identical to the OPTICOM® GPS system or employ another coding scheme.

SUMMARY

The various embodiments of the invention provide methods and systems for managing traffic signal preemption data accumulated at a plurality of intersections. In one embodiment, a method includes reading the preemption data stored at each of the intersections. The preemption data includes for each preemption request, an emitter code, and a date and a time the preemption request was submitted. The preemption data read from the intersections are stored in a database. Each emitter code is associated with a vehicle name in the database. Selected preemption data and vehicle names are read from the database in response to user input. The selected preemption data and associated vehicle names are displayed. The preemption data stored in the database further includes data identifying the intersection from which preemption data was read.

In another embodiment, a method for managing traffic signal preemption data accumulated at a plurality of intersections is provided. The system includes a processor and a memory arrangement coupled to the processor. The memory arrangement is configured with instructions that when executed by the processor cause the processor to perform operations including reading the preemption data stored at each of the intersections. The preemption data includes for each preemption request, an emitter code, and a date and a time the preemption request was submitted. The preemption data read from the intersections are stored in a database. Each emitter code is associated with a vehicle name in the database. Selected preemption data and vehicle names are read from the database in response to user input. The selected preemption data and associated vehicle names are displayed. The preemption data stored in the database further includes data identifying the intersection from which preemption data was read.

A computer-readable medium is provided in another embodiment. The computer-readable medium includes a storage device configured with processor executable instructions for managing traffic signal preemption data accumulated at a plurality of intersections. The storage device is configured with instructions that when executed by a computer cause the computer to perform the operations of reading the preemption data stored at each of the intersections. The preemption data includes for each preemption request, an emitter code, and a date and a time the preemption request was submitted. The preemption data read from the intersections are stored in a database. Each emitter code is associated with a vehicle name in the database. Selected preemption data and vehicle names are read from the database in response to user input. The selected preemption data and associated vehicle names are displayed. The preemption data stored in the database further includes data identifying the intersection from which preemption data was read.

The above summary of the present invention is not intended to describe each disclosed embodiment of the present invention. The figures and detailed description that follow provide additional example embodiments and aspects of the present invention.

BRIEF DESCRIPTION OF THE DRAWINGS

FIG. 10 is a block diagram of an example computing arrangement which can be configured to implement the processes performed by the preemption controller and the central management server described herein.

DETAILED DESCRIPTION

The embodiments of the present invention provide a method for monitoring, managing, and presenting traffic signal preemption data accumulated at a plurality of centrally managed intersections.

Preemption controllers of the centrally managed intersections may be configured to grant preemption to requesting vehicles belonging to different jurisdictions or agencies. In practice, higher level relationships between vehicles, such as agency or jurisdiction, are not known to the preemption controller. Rather, the preemption controllers operate based on a list of emitter codes that are either authorized or not-authorized to preempt traffic control.

The simplified emitter code-based implementation increases interoperability with older emitter systems that transmit a unique emitter code but do not transmit information relating to an agency, jurisdiction, or classification, of the vehicle. However, the simplified emitter code-based solution also obscures higher level relationships that exist between the emitter codes and particular vehicles, agencies, and jurisdictions, for example. The various embodiments of the invention provide a method to retrieve, manage, and present data accumulated by preemption controllers in a manner such that higher level relationships of vehicles requesting preemption are determined and/or maintained.

As used herein, the term "emitter" refers to the various types of modules capable of communicating a preemption request to a preemption controller. This includes, for example, IR light-based modules, GPS-based modules, and wireless network-based modules. In addition, a preemption request refers to both preemption requests that emanate from emergency vehicles and to what are sometimes referred to as "priority requests," which emanate from mass transit vehicles, for example.

Figure 1:
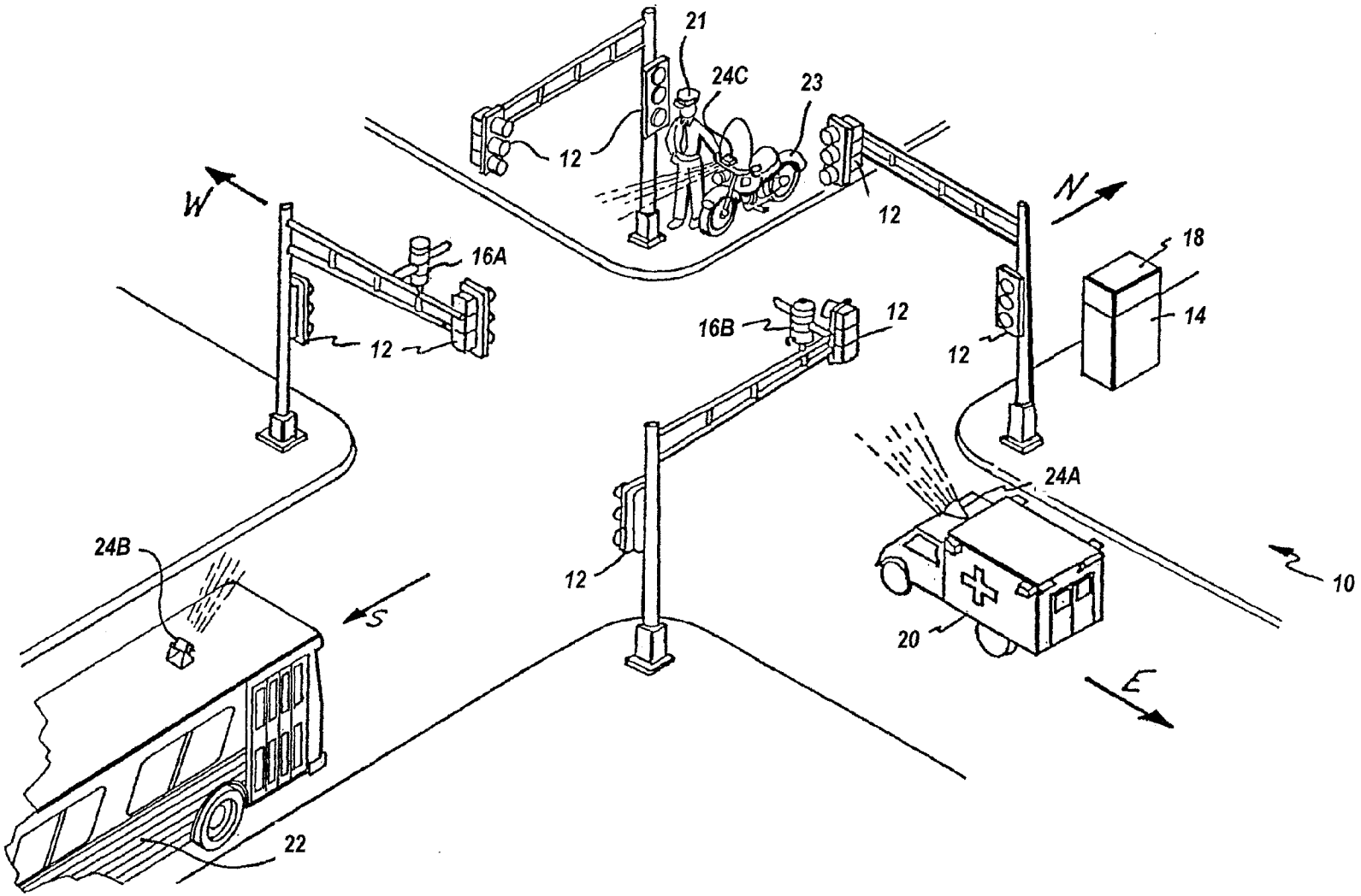
FIG. 1 is an illustration of a typical intersection having traffic signal lights and a traffic control preemption system.

FIG. 1 is an illustration of a typical intersection 10 having traffic signal lights 12. The equipment at the intersection illustrates the environment in which embodiments of the present invention may be used. A traffic signal controller 14 sequences the traffic signal lights 12 to allow traffic to proceed alternately through the intersection 10. The intersection 10 may be equipped with a traffic control preemption system such as the OPTICOM® Priority Control System.

The traffic control preemption system shown in FIG. 1 includes detector assemblies 16A and 16B, signal emitters 24A, 24B and 24C, a phase selector (not shown), a traffic signal controller 14, and a preemption controller 18. The detector assemblies 16A and 16B are stationed to detect signals emitted by authorized vehicles approaching the intersection 10. The detector assemblies 16A and 16B communicate with the phase selector, which is typically located in the same cabinet as the traffic controller 14.

In FIG. 1, an ambulance 20 and a bus 22 are approaching the intersection 10. The signal emitter 24A is mounted on the ambulance 20 and the signal emitter 24B is mounted on the bus 22. The signal emitters 24A and 24B each transmit a signal that is received by detector assemblies 16A and 16B. The detector assemblies 16A and 16B send output signals to the phase selector. The receiver circuit 18 processes the output signals from the detector assemblies 16A and 16B to determine the signal characteristics including: frequency, intensity, and security code of the signal waveform, or pulses. The security code, consisting of the vehicle class and vehicle identification is encoded in the signal by interleaving data pulses between the base frequency pulses. In GPS systems, location, speed, and heading of the vehicle are also determined and transmitted. If an acceptable frequency, intensity, and/or security code is observed the phase selector generates a preemption request to the traffic signal controller 14 to preempt a normal traffic signal sequence. The phase selector alternately issues preemption requests to and withdraws preemption requests from the traffic signal controller, and the traffic signal controller determines whether the preemption requests can be granted. The traffic signal controller may also receive preemption requests originating from other sources, such as a nearby railroad crossing, in which case the traffic signal controller may determine that the preemption request from the other source be granted before the preemption request from the phase selector. In some embodiments of the present invention the function of the phase selector is performed solely by the traffic controller.

The traffic controller determines the priority of each signal received and whether to preempt traffic control based on the security code contained in the signal. For example, the ambulance 20 may be given priority over the bus 22 since a human life may be at stake. Accordingly, the ambulance 20 would transmit a preemption request with a security code indicative of a high priority while the bus 20 would transmit a preemption request with a security code indicative of a low priority. The phase selector would discriminate between the low and high priority signals and request the traffic signal controller 14 to cause the traffic signal lights 12 controlling the ambulance's approach to the intersection to remain or become green and the traffic signal lights 12 controlling the bus's approach to the intersection to remain or become red.

Generally, a traffic controller must be preprogrammed to determine whether to preempt traffic control for a given security code and priority. Manual programming and monitoring of traffic controllers can be labor intensive and expensive. The present invention provides several options for centralized control and management of preemption controllers.

The centrally managed preemption systems of the present invention provide a preemption controller 18 which can be updated from a centralized control apparatus with security codes authorized to preempt traffic control along with any associated priority. When the preemption controller receives a preemption request, the preemption controller determines whether the security code is authorized and the priority associated with the security code. Preemption candidates with valid security codes are reviewed with other detected vehicles to determine the highest priority vehicle. Vehicles of equivalent priority are generally selected in a first come, first served manner, but could be further differentiated by class of vehicle. A preemption request is issued to the controller for the approach direction with the highest priority vehicle travelling on it.

When a preemption request is received, the preemption controller stores a record of the request in a preemption log. Each stored entry in the log includes preemption data such as: the emitter code of the requesting vehicle; the time and date of the request; the direction or approach from which the request was received; whether the request was granted; etc. This stored information can later be uploaded to a central management server and used to analyze preemption use and/or generate reports. To assure correct operation of preemption control of each intersection, some embodiments store the status of the lights at the end of preemption control. The status indicates the direction in which traffic was preempted and whether the light and/or turning lane lights were green when preemption control ended. This information can be compared at the central control server to determine if the preemption controller of the intersection is operating as expected.

Figure 2:
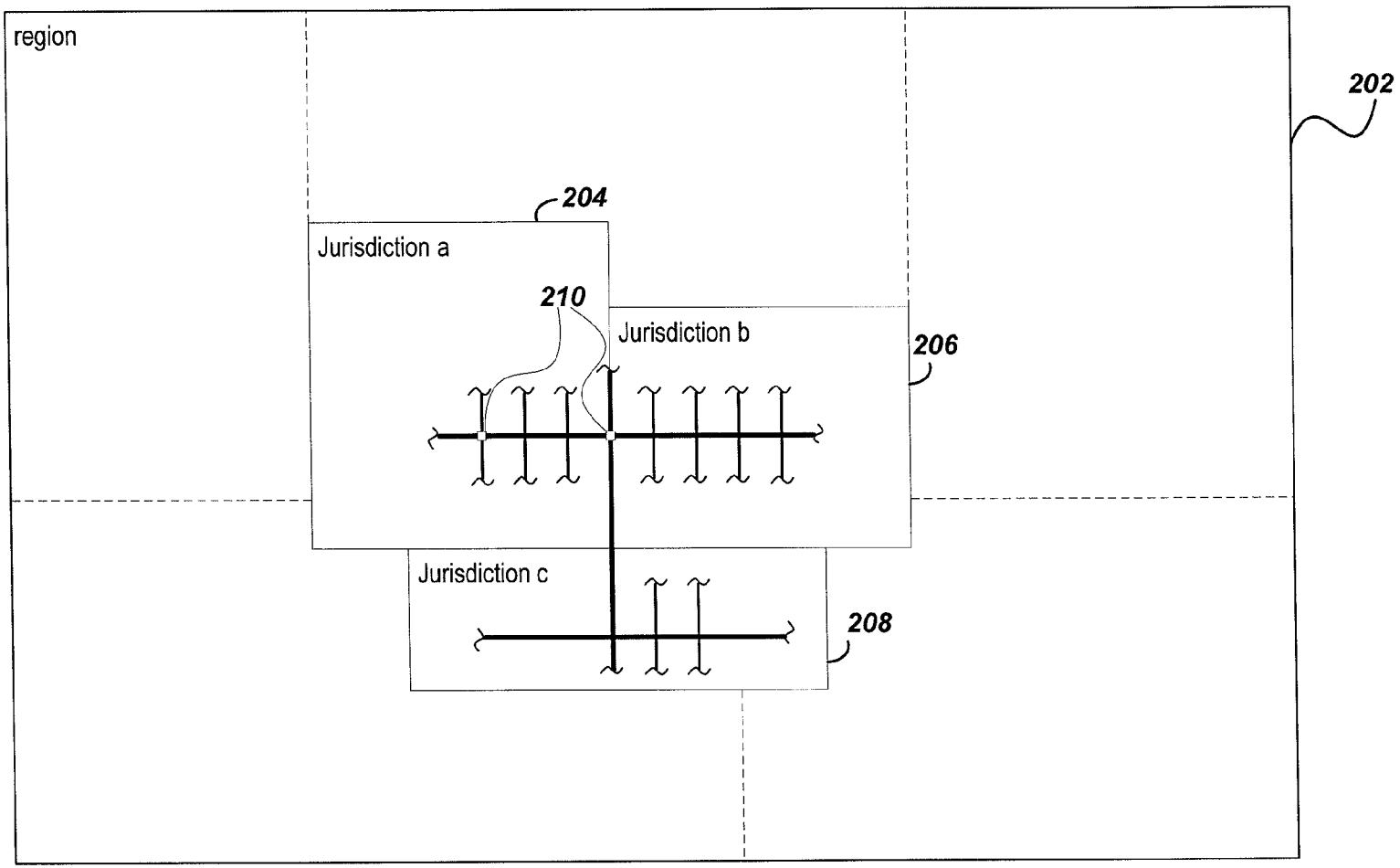
FIG. 2 shows the relationship between a region, multiple jurisdictions, and intersections of example roads within the jurisdictions.

FIG. 2 shows the relationship between a region, multiple jurisdictions, and intersections of example roads within the jurisdictions. Region 202 includes a plurality of jurisdictions, of which, example jurisdiction A 204, jurisdiction B 206, and jurisdiction C 208 are shown. A plurality of roads and intersections are shown in the jurisdictions with centrally controlled intersections 210 shown. Between two jurisdictions, roads may be shared, in that a road crosses between the two jurisdictions or marks the border between the jurisdictions. Alternatively a road may be wholly contained in a single one of the jurisdictions.

The preemption controllers within each jurisdiction within a region may be managed (configured and queried) as a group or individually. Among other management tasks, the preemption controllers in a particular jurisdiction can be collectively configured to operate in a selected security mode that controls which vehicles (via their emitters and associated emitter identifiers) are allowed to preempt traffic control signals in that jurisdiction.

A security level may be defined or updated for one or more jurisdictions to be managed. For example, in one implementation there are four security settings available: level 0, in which all emitter codes are authorized; level 1, in which all emitter codes are authorized except for uncoded emitters; level 2, in which all emitter codes are authorized except for uncoded emitters and default emitter codes; and level 3, in which only emitter codes assigned to the jurisdiction and jurisdictions or agencies granted mutual aid are authorized. Uncoded emitters are those that emit a signal without conveying an emitter code. This type of emitter is configurable to signal either a high or low priority request through the use of different frequencies. The preemption controller may be configured to allow both high and low priority requests, only high priority requests or neither high nor low priority requests. Default emitter codes are emitted from emitters that have not been configured with a particular identifier code. For example, a default emitter code value may be 1.

For each jurisdiction, the security level settings of each jurisdiction defined may be optionally supplemented by granting or denying preemption authorization to vehicles from other jurisdictions, selected agencies, and individual emitter codes. Mutual aid jurisdiction settings may be optionally defined for a jurisdiction in response to user input selecting a jurisdiction for mutual aid.

From the defined security level, a respective set of emitter codes is generated based on: the security level, any mutual aid settings, any agency settings, and any individual emitter security code settings. Preemption controllers are configured by downloading the generated emitter codes to the preemption controllers. During operation, preemption requests are granted only for downloaded emitter codes. By configuring preemption controllers using lists of emitter codes, the system allows configuration to be performed based on high level decisions, such as jurisdiction or agency, but retains interoperability with older emitters which do not transmit data indicating jurisdiction, agency, or class of vehicle. The embodiments of the present invention allow log data, which is accumulated and maintained by the preemption controller at a lower level, to be organized according to higher level relationships, such as agencies or jurisdictions, and presented to the user. By organizing and presenting data in this fashion, administrators can more easily analyze and verify operation of the system according to rules based on the relationship between emitter codes.

Figure 3:
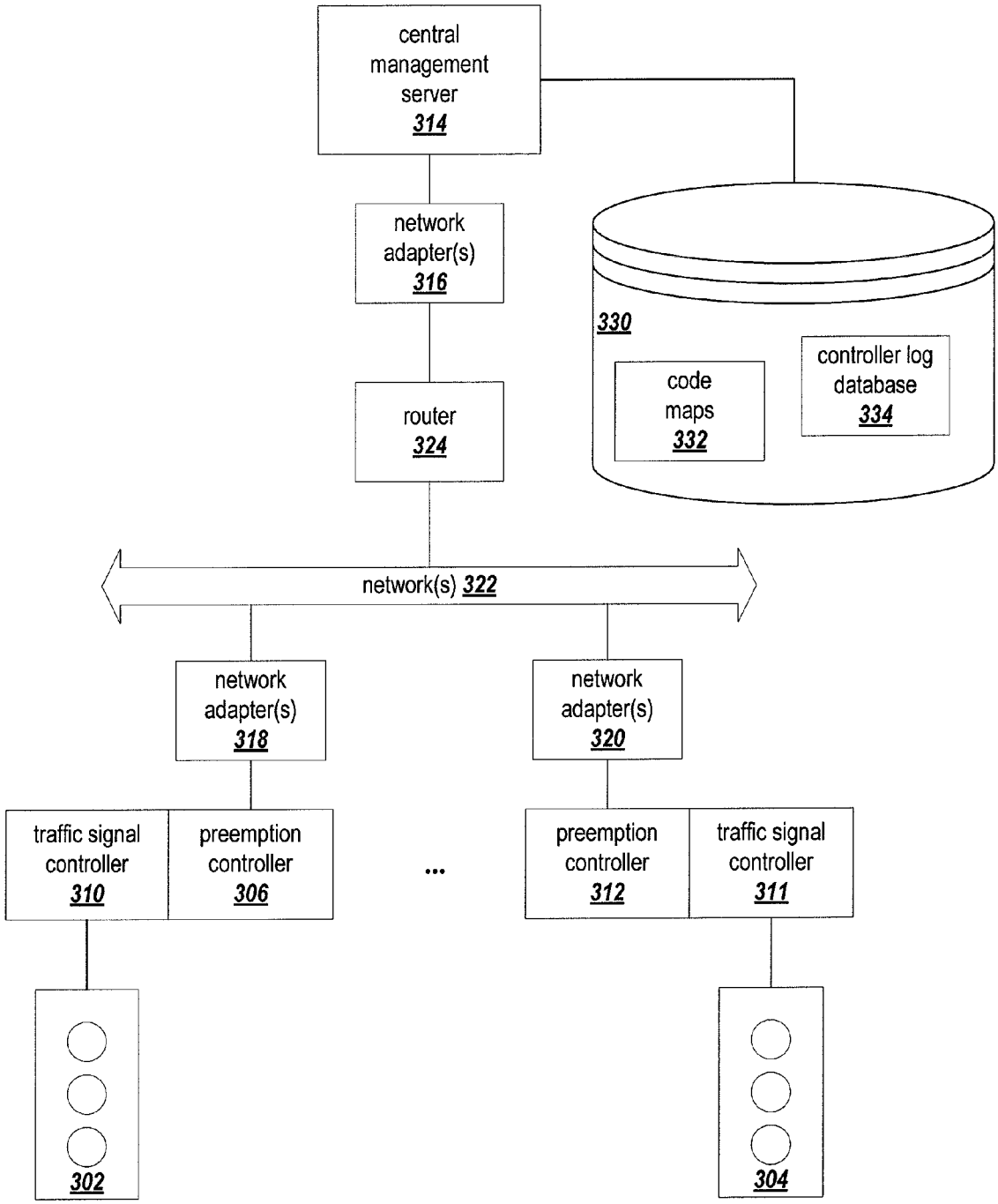
FIG. 3 shows a block diagram, as an example, of a system for managing traffic signal preemption in accordance with several embodiments of the invention.

FIG. 3 shows a block diagram, as an example, of a system for managing traffic signal preemption in accordance with several embodiments of the invention. Traffic lights 302 and 304 at intersections with preemption controllers are coupled to traffic signal controllers 310 and 311, respectively. Traffic signal controllers 310 and 311 are connected to respective preemption controllers 306 and 312. Each preemption controller is configured to store a log of preemption request data in local storage (not shown). A central management server 314 and the preemption controllers are respectively coupled to network adapters 316, 318, and 320 for communication over a network 322. In various embodiments, a router or a network switch, as shown by router 324, may be coupled between the network adapter and the network. It is understood the central management server 314 and the preemption controllers 306 and 312 may be connected through more than one network, coupled by additional switches and routing resources, including a connection over the Internet.

The central management server 314 is additionally coupled to a database server 330. Code maps 332 contain respective sets of codes for the jurisdictions managed by the central management server 314 and are stored on server 330. A database of preemption controller log data 334 that has been retrieved from preemption controllers is also stored on server 330. It is understood that file server 330 may comprise several local and/or remote servers.

In various embodiments of the present invention, retrieval of preemption control data from the geographically dispersed preemption controllers is accomplished from the central management server. An administrator is provided with the ability to specify at the jurisdiction level those vehicles that are authorized to preempt traffic signals within the jurisdictions. Some embodiments refer to the administrator as a systems administrator or a user and such terms are used interchangeably herein.

Data retrieval and/or configuration are accomplished by the central management server establishing a connection with a preemption controller. Once a connection is established, the preemption data log stored on the preemption controller is uploaded to the central management server. The uploaded log data are then stored in the controller log database 334. During the connection, or in a separately initiated connection, the preemption controller can be configured by downloading security codes onto the preemption controller. In some embodiments, the connection for configuration and/or data retrieval is initiated and established by the preemption controller.

It is understood that numerous network transfer protocols may be used to establish, maintain, and route connections including: TCP/IP, UDP, NFS, ESP, SPX, etc. It is also understood that network transfer protocols may utilize one or more lower layers of protocol communication such as ATM, X.25, or MTP, and on various physical and wireless networks such as, Ethernet, ISDN, ADSL, SONET, IEEE 802.11, V.90/v92 analog transmission, etc.

Figure 4:
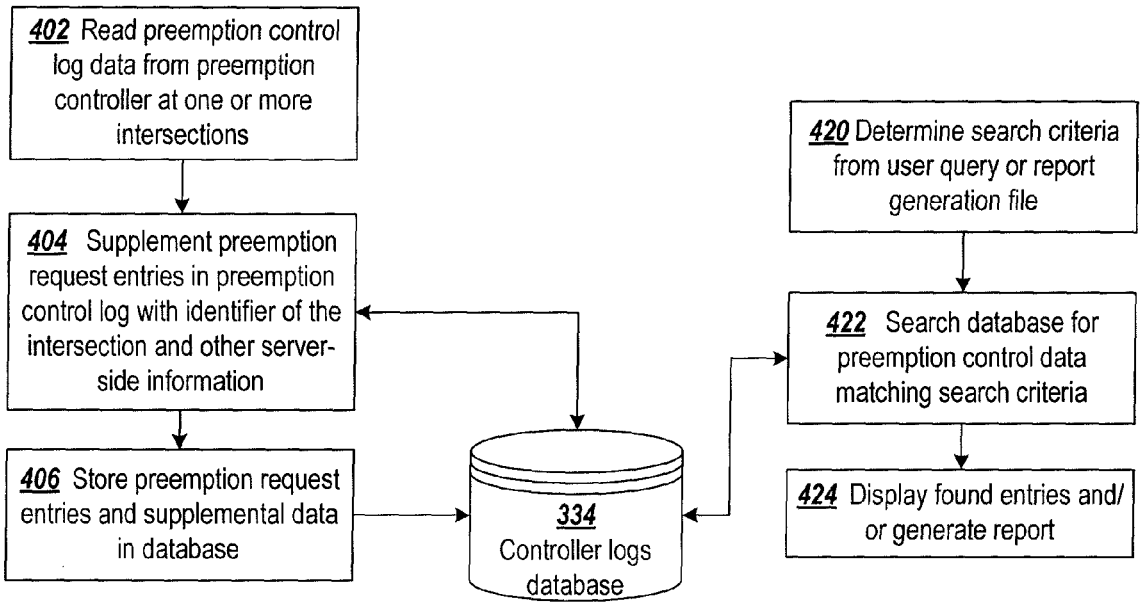
FIG. 4 is a flowchart of an example process for retrieval, storage, and the subsequent management of traffic signal preemption data in accordance with several embodiments of the invention.

FIG. 4 is a flowchart of an example process for retrieval, storage, and the subsequent management of traffic signal preemption data in accordance with several embodiments of the invention. Preemption log data are read from preemption controllers of one or more intersections at step 402. Preemption request entries in the preemption log are supplemented with data identifying the intersection from which they were uploaded at step 404. In some embodiments, entries may further be supplemented or associated at step 404 with other information available on the server such as the vehicle name, agency, or jurisdiction associated with the emitter code of each entry. The entries and supplemental data are stored in the controller logs database 334 at step 406.

Preemption log data stored in the database 334 can be searched according to search criteria. The search criteria are determined from user commands or from instructions in an automated report generation file at step 420. The database 334 is searched at step 422 based on the determined search criteria. Entries matching the search criteria are then displayed or used to generate a report at step 424.

It will be appreciated that various database configurations and database engine interfaces may be used. The organization of preemption data in the database may be row-oriented, column-oriented, object-oriented, document-oriented, or any combination of these. For example, in each preemption request entry in a row oriented system, a row with the preemption data may include the corresponding agency and jurisdiction. Alternatively, to save storage space, the row and jurisdiction corresponding to each preemption code may be stored separately and linked with pointers or a common data value.

The central management server 314 may organize preemption data into a storage format directly or may rely on a database engine, also known as a database management system, to organize, structure, and link related preemption data. When preemption log data entries are supplemented or associated with server-side information, the central management server may store supplemental data from the database directly, or rely on the database engine to copy or link supplemental data associated with the emitter code of each preemption request entry. If a database engine is used, storage, retrieval, and searching of data is performed by making requests to the engine in a defined query language. Some common query languages include: SQL, OQL, LINQ, JDOQL, JPAQL, among others. Although syntax and function can vary from one database engine to another, a search request in the form of a query command typically includes one or more search objects and/or fields linked by logical operators such as >, <, >=, <=, AND, OR, NOT, GroupBY, etc.

Figure 5:
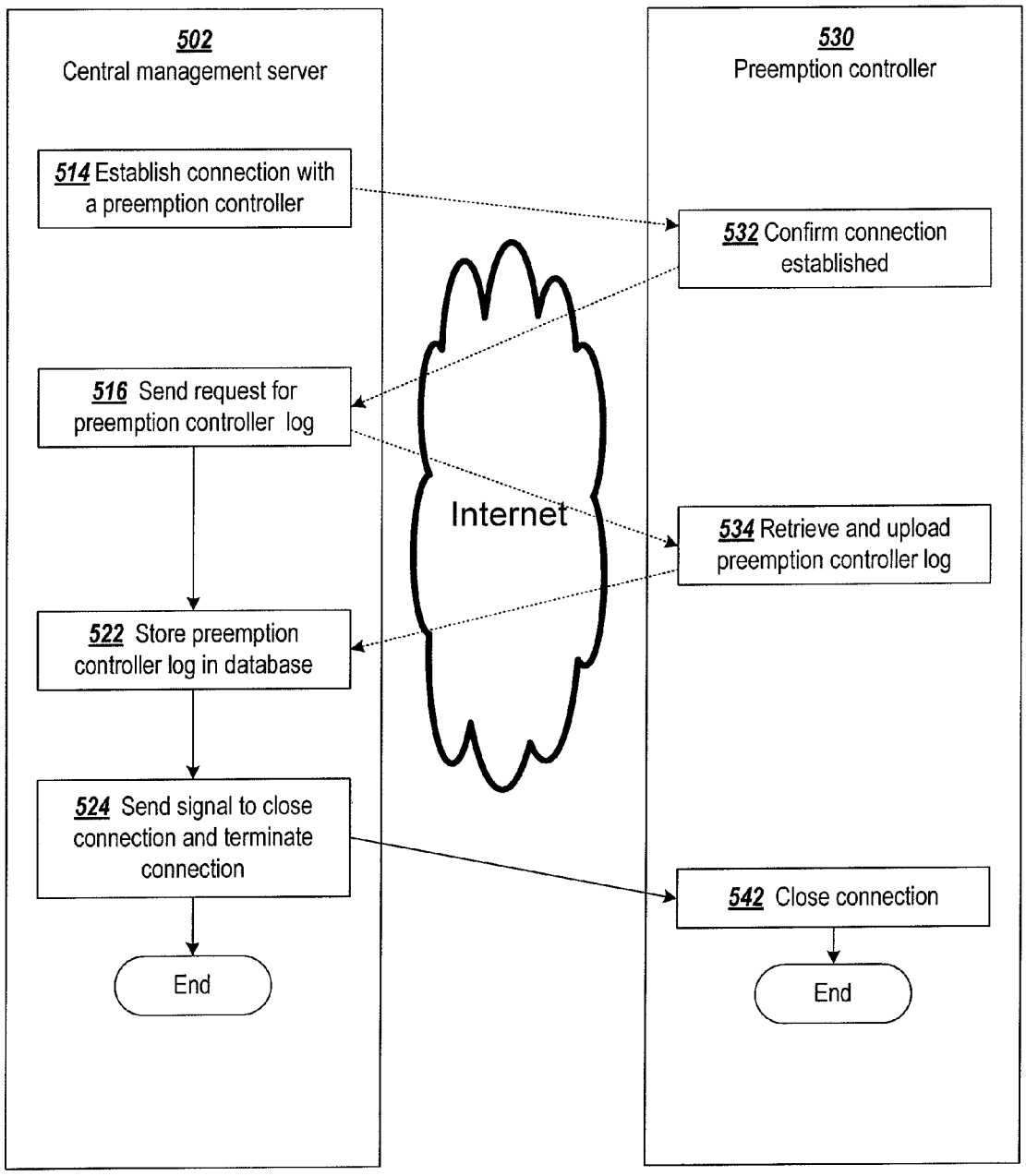
FIG. 5 illustrates, as an example, a flowchart of a process for remote retrieval of a preemption controller log data.

FIG. 5 illustrates, as an example, a flowchart of a process for remote retrieval of a preemption controller log data. The central management server 502 establishes a connection with the preemption controller 530 to be read at step 514. The preemption controller responds by confirming the connection at step 532. It is understood that establishment and maintenance of the connection include various data exchanges dependent on the communication protocol implemented. The central management server 502 sends a request to retrieve the preemption controller log at step 516. When the request is received, preemption controller 530 retrieves the preemption controller log from local storage and uploads the preemption controller log to the central management server 502 at step 534. Example data in the controller log include for each preemption request, the emitter code, the duration of the call, the priority of the request, which phases of the traffic signal were green, the approach on which the request was submitted, whether preemption was granted, the intensity of the received signal, etc.

The central management server also sets the clock on each preemption controller and pulls the configuration data from the preemption controllers. The configuration data of a preemption controller includes the set of emitter codes that are recognized for preempting the coupled traffic signal. This configuration data may be useful in flagging which emitter codes in the controller log were not in the set of permitted emitter codes for that preemption controller.

Once successfully received, the uploaded preemption controller log is stored in the database at step 522. The central management server also stores data denoting the last log record read from the preemption controller for use the next time the central management server requests the preemption controller log. The next time the central management server requests the preemption controller log the central management server ignores the log records preceding and including the denoted last read log record and processes the log records that follow the denoted log record.

After the preemption controller log is stored in the database at step 522, the central management server 502 sends a signal to close connection and terminates the connection on the server side at step 524. When the preemption controller receives the termination command, the preemption controller stops the connection at step 542 and ends the process on the controller side.

Figure 6:
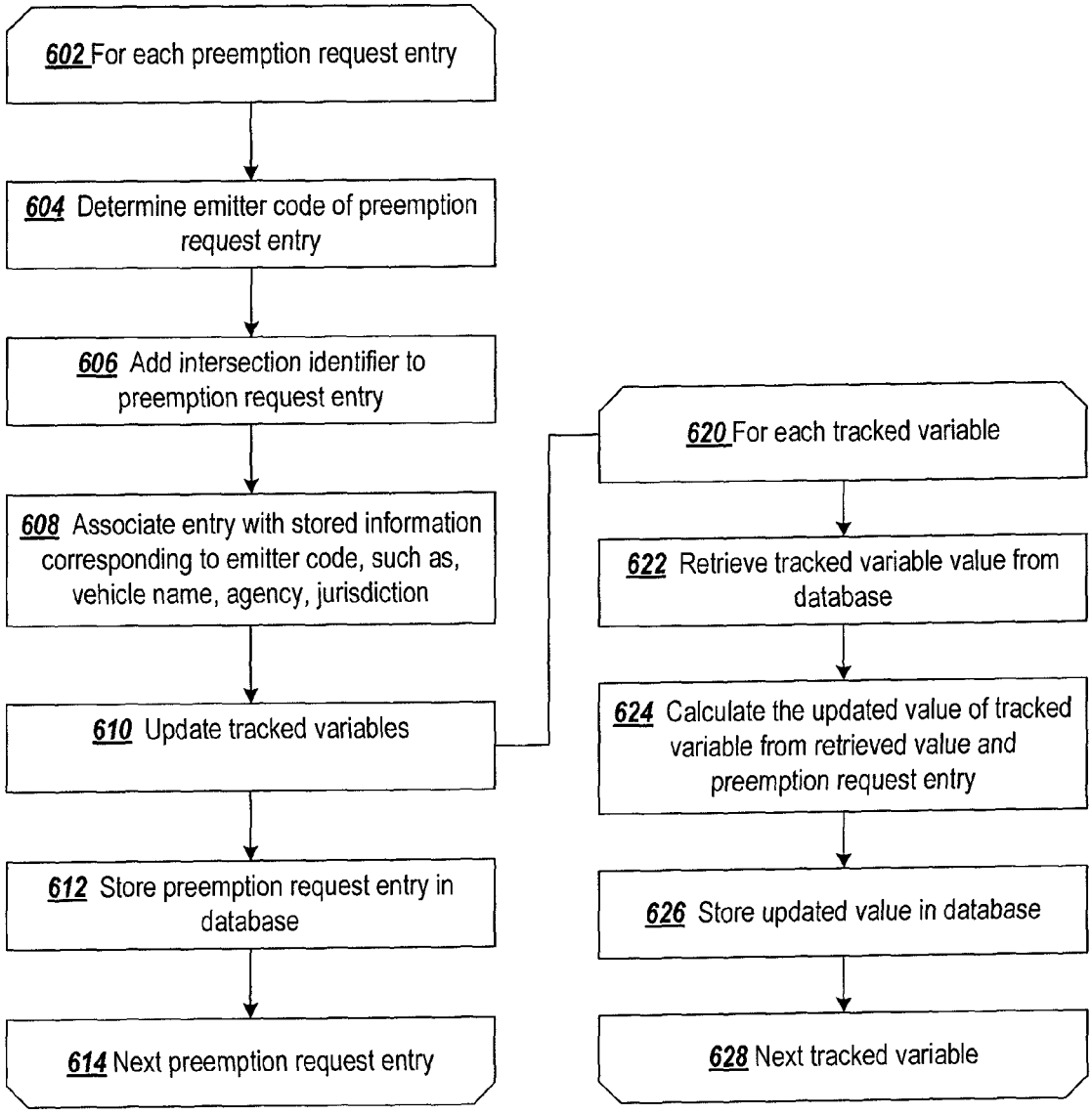
FIG. 6 illustrates, as an example, a flowchart of a process for processing and storing uploaded preemption controller log data in accordance with various embodiments of the invention.

FIG. 6 illustrates, as an example, a flowchart of a process for processing and storing uploaded preemption controller log data in accordance with various embodiments of the invention. For each preemption request entry 602 in the log, the emitter code of the preemption request entry is determined at step 604. Data identifying the intersection from which the preemption controller log was uploaded is added to the entry at step 606. Some embodiments add or link each entry with other supplemental data corresponding to emitter codes, at step 608, such as, vehicle name, agency, jurisdiction, etc.

Further embodiments also store in association with each intersection, data that describe the phases of the traffic signal expected to be green for each approach to the intersection ("expected green phases"). For example, for a particular intersection when there is a preemption request on the northbound approach to an intersection, the phase controlling northbound lanes would be expected to be green. In the example, some applications may also designate that a phase controlling a left-turn lane from the northbound approach to a westbound lane also be green. The preemption log data read from the preemption controllers include data that indicate for each preemption request, which phases of the traffic signal were green. The expected green phases may be compared to the actual green phases resulting from preemption requests at an intersection to determine whether or not a problem exists with the preemption controller or traffic signal controller.

In another embodiment, the log data read back from the preemption controller is further supplemented to indicate which emitter codes in the controller log were not in the sets of permitted emitter codes for particular preemption controllers. This may be useful in reporting by intersection, those emitter codes seeking preemption, but the requesting emitter code was not allowed at that intersection.

Some embodiments of the invention maintain tracked variables to pre-compute some search intensive calculations. For example, an administrator may wish to periodically review how many preemption requests have been granted for each registered vehicle. This calculation would require every entry in the data base to be searched and counted. Search time can be saved by updating a tracked variable for each emitter code which contains the number of preemption requests granted. By updating the tracked variable when new entries are added to the database, a search of the entire database can be avoided.

When a preemption request entry is processed at step 610, each tracked variable is updated at step 620. A tracked variable is retrieved from the database at step 622. An updated value of the tracked variable is calculated from the retrieved value and preemption request entry at step 624. The updated value is then stored in the database at step 626 and the next tracked variable is updated at step 628.

When all processing of the preemption request entry has completed, the preemption request is stored in the database at step 612 and the next preemption request entry is processed at step 614.

Figure 7:
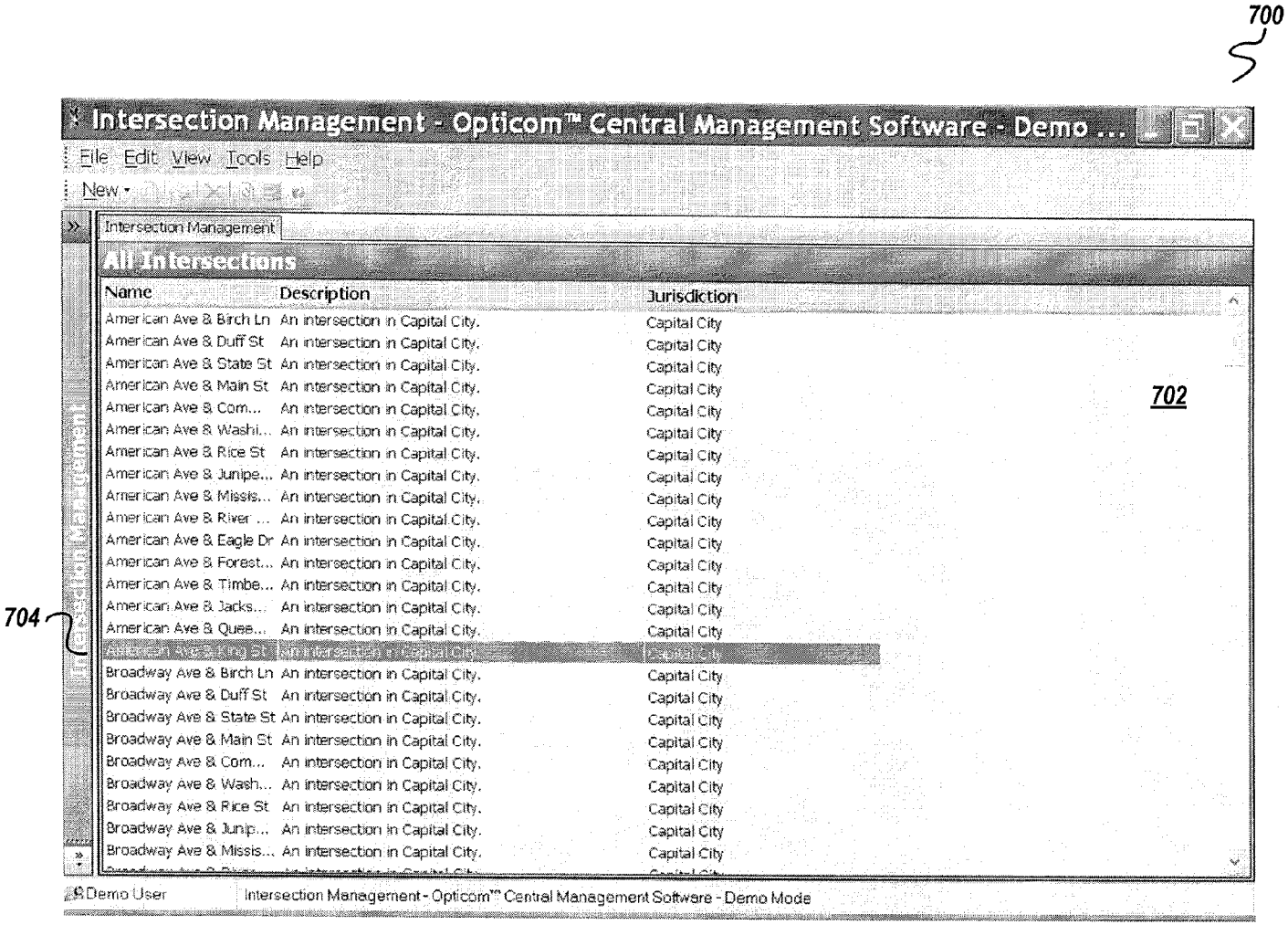
FIG. 7 shows an example user interface for retrieving preemption request entry data associated with an intersection from a database.
Figure 8:
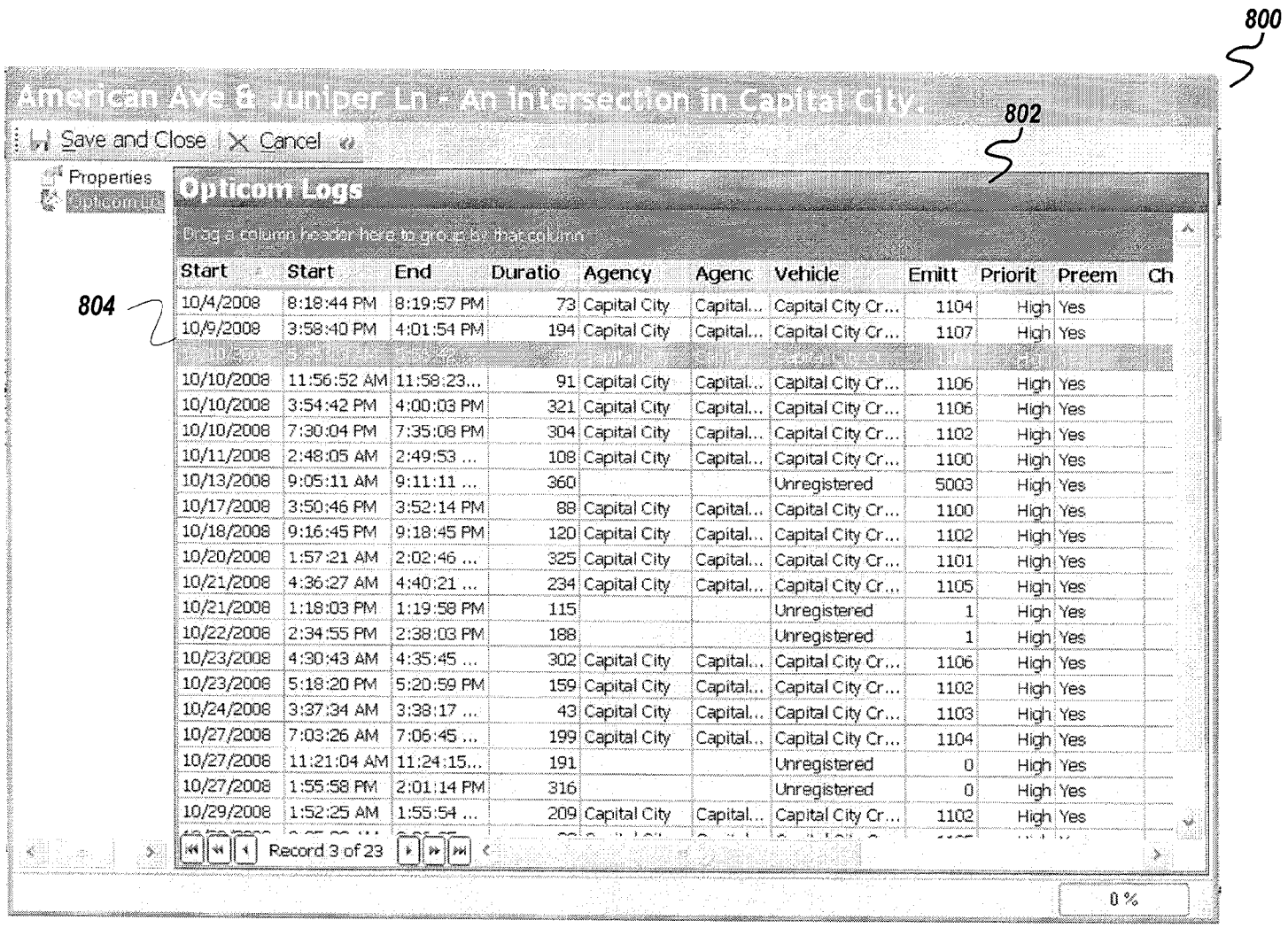
FIG. 8 shows an example interface screen for displaying preemption request entries.

FIGS. 7 and 8 show an example user interface for retrieving and displaying preemption request entry data from the database. FIG. 7 shows an example interface screen 700 with a window pane listing intersections registered in the database 702. For each intersection, the name of the intersection, a description of the intersection, and the jurisdiction of the intersection is listed. Preemption request entries can be viewed by highlighting an entry, as shown by 704, and double clicking.

FIG. 8 shows an example interface screen 800 for displaying preemption request entries for an intersection selected in FIG. 7. Preemption request entries are displayed in window pane 802. For each individual entry 804, entry data is displayed such as the date of the preemption request, start and stop time of granted preemption, duration of preemption, agency associated with the emitter code, vehicle identifier, emitter code, priority of the request, whether preemption request was granted, etc.

The example in FIG. 7 searches the database for preemption request entries by intersection. Various embodiments of the invention provide interfaces for alternate/additional search query criteria. For example, search criteria may include a search by one or more: emitter codes; agencies; jurisdictions; priority; vehicle class; date range; time range; preemption status, or a combination of these and/or others. In addition, some embodiments provide an interface to generate various reports from data stored in the database.

Figure 9:
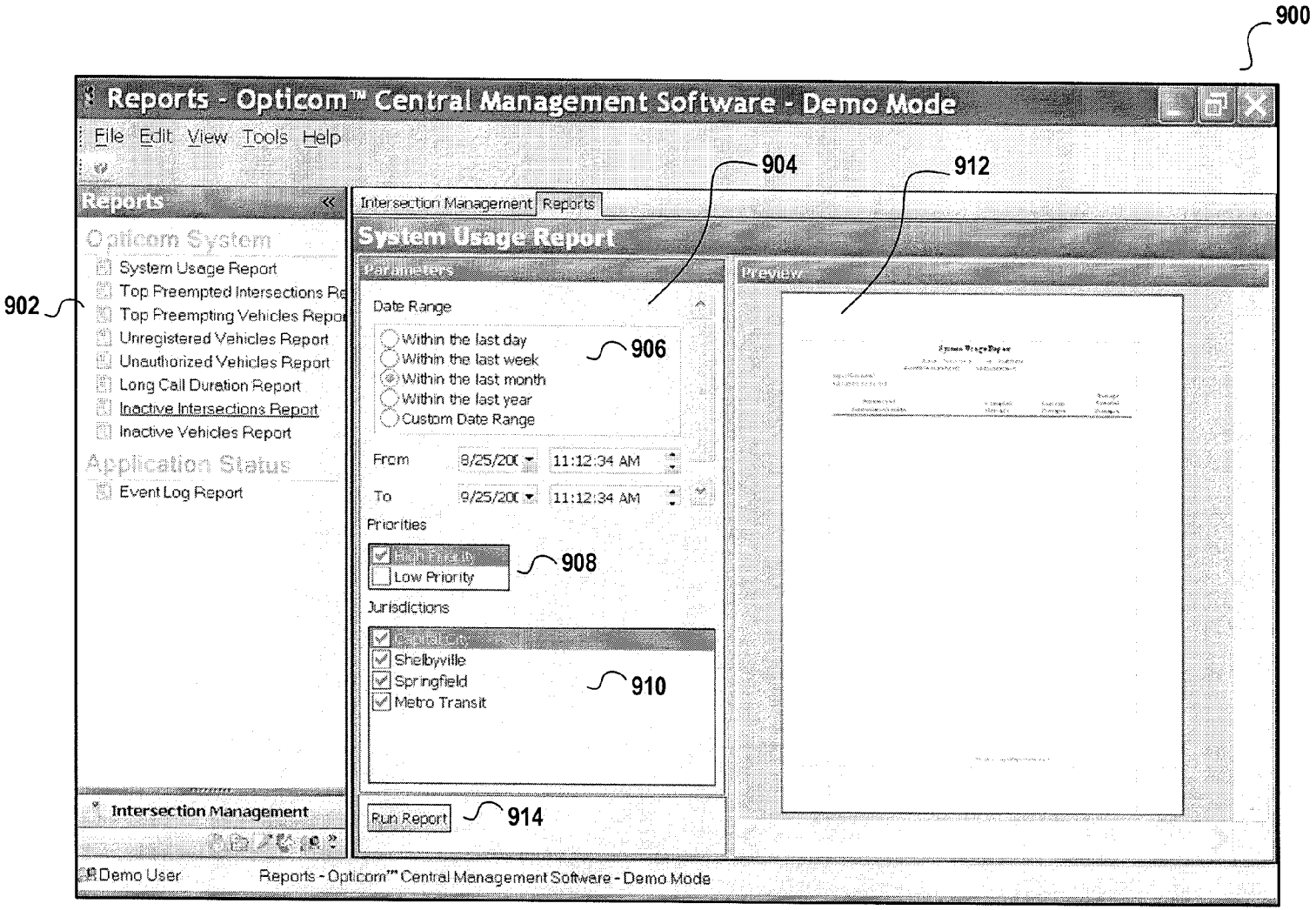
FIG. 9 shows an example user interface for generating reports from stored preemption data.

FIG. 9 shows an example user interface for generating reports from stored preemption data. Interface screen 900 includes a report selection window pane 902. When a user selects a report from selection pane 902, the report is configured in configuration pane 904. Configuration pane 904 includes a date range selection interface 906. By selecting a date range the report will only be generated from preemption request entries falling within the selected date range. A priority selection 908 is provided to restrict preemption request entries used in report generation to those of a selected priority. The preemption request entries used to generate a report may also be restricted to selected jurisdictions using selection interface 910. Reports may also be generated using other restrictions such as: start and stop time of granted preemption, duration of preemption, agency associated with the emitter code, vehicle identifier, emitter code, whether a preemption request was granted, preemption status, etc. A sample preview of the format is shown in window pane 912. A report is generated when the user selects Run Report button 914.

Other reporting functions are provided by various embodiments of the present invention. FIGS. 10-16 show report functions that may be provided by various embodiments of the present invention.

FIG. 10 shows, as an example, a generated report of system usage. System usage reporting can be used to provide a summary breakdown of preemption requests for one or more intersections grouped by two or more specified categories. FIG. 10 shows the generated report broken down into subgroups of intersections, registered and unregistered vehicles, and authorized and unauthorized vehicles.

FIG. 11 shows, as an example, a generated report listing vehicles with the highest number of preemption requests over a 1 week period. Emitter codes are listed in descending order based on the number of preemption requests received. For registered emitter codes the agency name, vehicle name, and jurisdiction are listed.

FIG. 12 shows, as an example, a generated report listing the top five intersections reporting the highest number of preemption requests. For each of the top five intersections, the total number of preemption requests is shown and is also subgrouped by approach direction. Priority of the approach is also indicated.

FIG. 13 shows, as an example, a generated report listing preemption requests from unregistered emitter codes. For each request, the report shows the emitter codes, the priority indicated, the associated jurisdiction, the intersection, the approach, the time of the request, and whether the request was granted.

FIG. 14 shows, as an example, a generated report listing granted preemptions in which traffic control was preempted for a specified duration or longer. In the example shown, the report was generated to show preemptions with duration longer than 90 seconds. For each preemption with duration greater than 90 seconds, the emitter code, priority, intersection, approach, start time, and duration are shown. For registered emitter codes, the vehicle name, agency, and jurisdiction are also listed if available.

FIG. 15 shows, as an example, a generated report listing inactive vehicles. A vehicle is considered inactive during a specified time period if no preemption requests are recorded for that time period. For each inactive vehicle, the emitter code, vehicle identifier, vehicle name, agency, jurisdiction, and priority are shown.

FIG. 16 shows, as an example, a generated report listing inactive intersections during a specified time period. An intersection is considered inactive if no preemption requests are received during the relevant time period. For each determined inactive intersection, the jurisdiction, intersection, approach, and priority setting is listed.

Users can generate customized reports by specifying search criteria to define preemption entries, vehicles, or intersections to be included in the results, and by specifying fields and order in which to display determined results. It is understood that the user may configure generated reports to further arrange results into subgroups according to other categories such as agency or jurisdiction, for example. It is also understood that the user may adjust select preemption request entries to be included in the report by selecting search criteria such as a date range or jurisdiction. For ranked reports, the user may also adjust the number of results to display. For example, the user may select to display the top 5 results or the top 100 results.

Those skilled in the art will appreciate that various alternative computing arrangements, including one or more processors and a memory arrangement configured with program code, can be configured to perform the processes of the different embodiments of the present invention.

Figure 17:
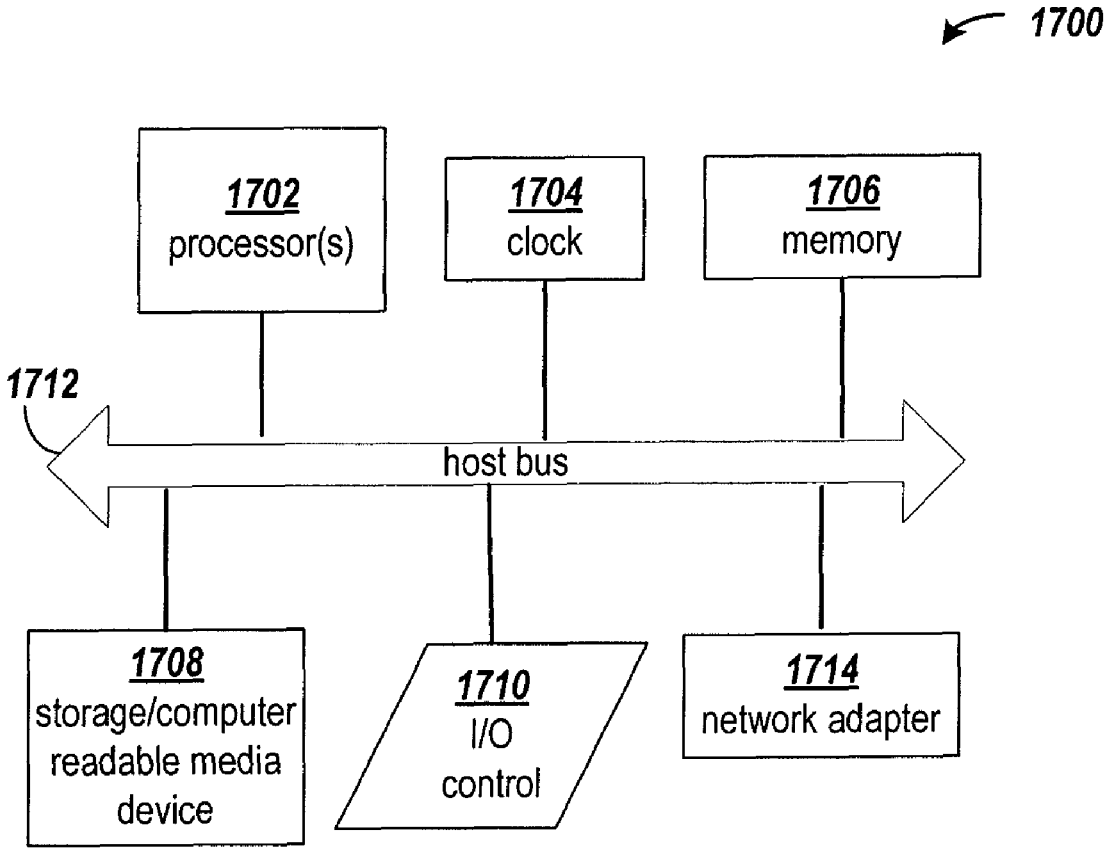

FIG. 17 is a block diagram of an example computing arrangement which can be configured to implement the processes performed by the preemption controller and central systems server described herein. Those skilled in the art will appreciate that various alternative computing arrangements, including one or more processors and a memory arrangement configured with program code, would be suitable for hosting the processes and data structures and implementing the algorithms of the different embodiments of the present invention. The computer code, comprising the processes of the present invention encoded in a processor executable format, may be stored and provided via a variety of computer-readable storage media or delivery channels such as magnetic or optical disks or tapes, electronic storage devices, or as application services over a network.

Processor computing arrangement 1700 includes one or more processors 1702, a clock signal generator 1704, a memory unit 1706, a storage unit 1708, a network adapter 1714, and an input/output control unit 1710 coupled to host bus 1712. The arrangement 1700 may be implemented with separate components on a circuit board or may be implemented internally within an integrated circuit. When implemented internally within an integrated circuit, the processor computing arrangement is otherwise known as a microcontroller.

The architecture of the computing arrangement depends on implementation requirements as would be recognized by those skilled in the art. The processor 1702 may be one or more general purpose processors, or a combination of one or more general purpose processors and suitable co-processors, or one or more specialized processors (e.g., RISC, CISC, pipelined, etc.).

The memory unit 1706 typically includes multiple levels of cache memory and a main memory. The storage unit 1708 may include local and/or remote persistent storage such as provided by magnetic disks (not shown), flash, EPROM, or other non-volatile data storage. The storage unit may be read or read/write capable. Further, the memory 1706 and storage 1708 may be combined in a single arrangement.

The processor arrangement 1702 executes the software in storage 1708 and/or memory 1706 arrangements, reads data from and stores data to the storage 1708 and/or memory 1706 arrangements, and communicates with external devices through the input/output control arrangement 1710 and network adapter 1714. These functions are synchronized by the clock signal generator 1704. The resource of the computing arrangement may be managed by either an operating system (not shown), or a hardware control unit (not shown).

The present invention is thought to be applicable to a variety of systems for a preemption controller. Other aspects and embodiments of the present invention will be apparent to those skilled in the art from consideration of the specification and practice of the invention disclosed herein. It is intended that the specification and illustrated embodiments be considered as examples only, with a true scope and spirit of the invention being indicated by the following claims.

What is claimed is:

1. A method for managing traffic signal preemption data accumulated at a plurality of intersections, comprising:

reading the preemption data stored by respective preemption controllers at the intersections, wherein the preemption data includes, for each preemption request, an emitter code, and a date and a time the preemption request was submitted by an emitter to the respective preemption controller;

storing the preemption data read from the intersections in a database;

associating each emitter code with a vehicle name in the database;

in response to a first user command identifying one or more emitter codes and an agency having one or more vehicles with one or more emitters that generate the one or more emitter codes, respectively, storing data in the database for each of the one or more emitter codes indicating the codes are associated with the agency;

reading selected preemption data and vehicle names from the database in response to a second user command; and in the preemption data read from the database, counting for each emitter code in the preemption data, a total number of preemption requests having the emitter code; and displaying the vehicle names, total numbers of preemption requests for the associated emitter codes, and agencies associated with the emitter codes;

wherein the reading of preemption data from the intersections, storing, associating, reading of preemption data from the database, and displaying are performed with a programmed computer; and wherein storing the preemption data includes storing data identifying the intersection from which preemption data was read.

2. The method of claim 1, further comprising:

in the preemption data read from the database, counting for each emitter code in the preemption data, a total number of preemption requests having the emitter code; and displaying vehicle names associated with one or more emitter codes having the greatest total number of counted preemption requests.

3. The method of claim 1, further comprising:

counting, for at least one emitter code in the stored preemption data, a total number of preemption requests having the emitter code and occurring between a first date and a second date; and displaying vehicle names associated with one or more emitter codes having the greatest total number of counted preemption requests.

4. The method of claim 1, further comprising:

in the preemption data read from the database, counting for each emitter code in the preemption data, a total number of preemption requests having the emitter code; and displaying for each emitter code having a total number of preemption requests equal to zero, the associated vehicle name.

5. The method of claim 1, further comprising:

wherein the preemption data stored at each of the intersections is logged by a preemption controller having a controller identifier;

associating each controller identifier with an intersection name in the database;

in the preemption data read from the database, counting for each controller identifier in the preemption data, a total number of preemption requests having the controller identifier; and displaying intersection names and total numbers of preemption requests ordered by the total number of preemption requests of the associated controller identifier.

6. The method of claim 5, further comprising:

in the preemption data read from the database, counting for each intersection channel of each controller identifier in the preemption data, a total number of preemption requests for the intersection channel; and displaying in association with each intersection name, the total number of preemption requests for each intersection channel of the associated controller identifier.

7. The method of claim 1, further comprising:

in response to a third user command indicating one or more intersections of the plurality of intersections and a jurisdiction, storing data in the database for each of the one or more intersections indicating the intersection is associated with the jurisdiction; and in response to a fourth user command:

determining a set of intersections that are associated with the jurisdiction; and displaying the set of intersections.

8. The method of claim 1, further comprising:

in response to a third user command indicating a date and one or more intersections of the plurality of intersections, storing data in the database indicating preemption data is to be retrieved from the one or more intersections on the date; and wherein, the reading of the preemption data stored by the preemption controllers at each of the intersections, the storing of the preemption data read from the intersections in the database, and the associating step are performed on the date.

9. The method of claim 1, wherein the preemption data for each preemption request further includes a value indicating an IR light intensity level detected at the respective intersection.

10. The method of claim 1, further comprising:

in response to a third user command:

reading a set of preemption data corresponding to preemption requests of one or more intersections of the plurality of intersections from the database; and displaying preemption requests of the set that are not associated with a vehicle name.

11. The method of claim 1, wherein the preemption data for each of one or more of the preemption requests further includes: a start time indicating a time at which a traffic signal changed to green for the preemption request and a stop time indicating a time at which the traffic signal changed from green for the preemption request.

12. The method of claim 1, further comprising:

in response to a third user command:

reading a set of stored preemption data corresponding to preemption requests with a date between a first date and a second date;

determining intersections of the plurality of intersections that are not associated with preemption requests of the set; and displaying data indicative of the determined intersections.

13. The method of claim 1, wherein the preemption data further includes approach data indicating a direction of travel of a vehicle having an emitter from which a preemption request was received.

14. The method of claim 1, wherein the preemption data further includes, for each preemption request, data indicating green phases of a traffic signal of the intersection, the method further comprising associating a set of expected green phases with each approach of one or more intersections of the plurality of intersections in the database.

15. The method of claim 1, wherein the preemption data stored by each of the preemption controllers at each of the intersections for each preemption request submitted by an emitter to the preemption controller further includes data indicating whether the preemption request was authorized.

16. The method of claim 1, further comprising:

prior to storing the preemption data read from the intersections, reading a first tracked variable from the database, wherein the first tracked variable is equal to the number of preemption requests stored in the database matching a set of search criteria;

determining a second tracked variable, wherein the second tracked variable is equal to the number of preemption requests in the preemption data read from the intersections matching the set of search criteria;

determining an updated value from the first and second tracked variables; and updating the first tracked variable in the database with the updated value.

17. A system for managing traffic signal preemption data stored at a plurality of intersections by respective preemption controllers, comprising:

a processor, a memory arrangement coupled to the processor, wherein the memory arrangement is configured with instructions that when executed by the processor cause the processor to perform the operations of:

reading the preemption data stored at each of the intersections, wherein the preemption data includes for each preemption request an emitter code, and a date and a time the preemption request was submitted by an emitter to the respective preemption controller at the intersection;

storing the preemption data read from the intersections in a database;

associating each emitter code with a vehicle name in the database;

in response to a first user command identifying one or more emitter codes and an agency having one or more vehicles with one or more emitters that generate the one or more emitter codes, respectively, storing data in the database for each of the one or more emitter codes indicating the codes are associated with the agency;

reading selected preemption data and vehicle names from the database in response to a second user command; and displaying the vehicle names, total numbers of preemption requests for the associated emitter codes, and agencies associated with the emitter codes; and wherein storing the preemption data includes storing data identifying the intersection from which preemption data was read.

18. A computer-readable medium, comprising:

a non-transitory storage device configured with processor executable instructions for managing traffic signal preemption data accumulated at a plurality of intersections, wherein the instructions, when executed by a computer, cause the computer to perform the operations of:

reading the preemption data stored by respective preemption controllers at the intersections, wherein the preemption data includes for each preemption request an emitter code, and a date and a time the preemption request was submitted by an emitter to the respective preemption controller;

storing the preemption data read from the intersections in a database;

associating each emitter code with a vehicle name in the database;

in response to a first user command identifying one or more emitter codes and an agency having one or more vehicles with one or more emitters that generate the one or more emitter codes, respectively, storing data in the database for each of the one or more emitter codes indicating the codes are associated with the agency;

reading selected preemption data and vehicle names from the database in response to a second user command;

in the preemption data read from the database, counting for each emitter code in the preemption data, a total number of preemption requests having the emitter code;

displaying vehicle names, total numbers of preemption requests for the associated emitter codes, and agencies associated with the emitter codes; and wherein storing the preemption data includes storing data identifying the intersection from which preemption data was read.

* * * * *